US007438649B2

(12) United States Patent
Ezaki et al.

(10) Patent No.: US 7,438,649 B2
(45) **Date of Patent: *Oct. 21, 2008**

(54) GOLF CLUB HEAD

(75) Inventors: Hiroshi Ezaki, Tokyo (JP); Yasunori Imamoto, Kawasaki (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 213 days.

This patent is subject to a terminal disclaimer.

(21) Appl. No.: 11/097,254

(22) Filed: Apr. 4, 2005

(65) Prior Publication Data

US 2005/0221914 A1 Oct. 6, 2005

(30) Foreign Application Priority Data

Apr. 2, 2004 (JP) ..... 2004-110162

(51) Int. Cl.
*A63B 53/04* (2006.01)

(52) U.S. Cl. ..... 473/345; 473/347; 473/349

(58) Field of Classification Search ..... 473/324–350
See application file for complete search history.

(56) References Cited

U.S. PATENT DOCUMENTS

| | | | | |
|---|---|---|---|---|
| 3,652,094 | A | 3/1972 | Glover | |
| 4,021,047 | A | 5/1977 | Mader | |
| 4,432,549 | A | 2/1984 | Zebelean | |
| 4,438,931 | A | 3/1984 | Motomiya | |
| 4,732,389 | A * | 3/1988 | Kobayashi | 473/348 |
| 5,205,560 | A | 4/1993 | Hoshi et al. | |
| 5,207,428 | A * | 5/1993 | Aizawa | 473/311 |
| 5,255,913 | A | 10/1993 | Tsuchida | |
| 5,501,459 | A * | 3/1996 | Endo | 473/346 |
| 5,547,427 | A | 8/1996 | Rigal et al. | |
| 5,570,886 | A | 11/1996 | Rigal et al. | |
| 5,624,331 | A | 4/1997 | Lo et al. | |
| 5,669,827 | A | 9/1997 | Nagamoto | |

(Continued)

FOREIGN PATENT DOCUMENTS

JP 05-068725 3/1993

(Continued)

OTHER PUBLICATIONS

U.S. Appl. No. 10/462,673, filed Jun. 17, 2003, Imamoto et al.*

(Continued)

*Primary Examiner*—Sebastiano Passaniti
(74) *Attorney, Agent, or Firm*—Sughrue Mion, PLLC

(57) ABSTRACT

A golf club head is formed from a front-face body made of a metal material, an FRP body, a metal sole plate, and a weight member. The front-face body is formed from a front-face body main body made of a crystalline metal, and a face plate which is fitted in an opening of the front-face body main body and fixedly attached thereto by means of caulking and which is made of an amorphous metal. The front-face body main body includes a face, a metal sole, a metal side portion (toe), a metal crown portion, a metal side portion (heel), and a hosel. A front edge of the sole plate and the metal sole are separated with a gap of about 4 to 12 mm therebetween, which forms the FRP body.

2 Claims, 5 Drawing Sheets

U.S. PATENT DOCUMENTS

| | | | | |
|---|---|---|---|---|
| 5,766,095 | A | 6/1998 | Antonious | |
| 5,967,904 | A | 10/1999 | Nagai et al. | |
| 5,997,415 | A | 12/1999 | Wood | |
| 6,010,411 | A | 1/2000 | Reyes | |
| 6,089,992 | A | 7/2000 | Onuki et al. | |
| 6,117,023 | A * | 9/2000 | Onuki et al. | 473/342 |
| 6,162,130 | A | 12/2000 | Masumoto et al. | |
| 6,248,025 | B1 | 6/2001 | Murphy et al. | |
| 6,254,494 | B1 | 7/2001 | Hasebe et al. | |
| 6,332,847 | B2 | 12/2001 | Murphy et al. | |
| 6,340,337 | B2 | 1/2002 | Hasebe et al. | |
| 6,348,013 | B1 * | 2/2002 | Kosmatka | 473/329 |
| 6,354,962 | B1 | 3/2002 | Galloway et al. | |
| 6,354,963 | B1 | 3/2002 | Kodama et al. | |
| 6,371,868 | B1 | 4/2002 | Galloway et al. | |
| 6,381,828 | B1 | 5/2002 | Boyce et al. | |
| 6,406,378 | B1 | 6/2002 | Murphy et al. | |
| 6,435,977 | B1 | 8/2002 | Helmstetter et al. | |
| 6,435,978 | B1 | 8/2002 | Galloway et al. | |
| 6,440,008 | B2 | 8/2002 | Murphy et al. | |
| 6,440,011 | B1 | 8/2002 | Hocknell et al. | |
| 6,471,604 | B2 | 10/2002 | Hocknell et al. | |
| 6,491,592 | B2 | 12/2002 | Cackett et al. | |
| 6,524,194 | B2 | 2/2003 | McCabe | |
| 6,524,198 | B2 | 2/2003 | Takeda | |
| 6,527,650 | B2 | 3/2003 | Reyes et al. | |
| 6,575,845 | B2 | 6/2003 | Smith et al. | |
| 6,582,321 | B2 | 6/2003 | Galloway et al. | |
| 6,582,323 | B2 | 6/2003 | Soracco et al. | |
| 6,602,149 | B1 | 8/2003 | Jacobson | |
| 6,607,452 | B2 | 8/2003 | Helmstetter et al. | |
| 6,620,056 | B2 | 9/2003 | Galloway et al. | |
| 6,623,378 | B2 | 9/2003 | Beach et al. | |
| 6,648,774 | B1 | 11/2003 | Lee | |
| 6,676,536 | B1 | 1/2004 | Jacobson | |
| 6,739,982 | B2 | 5/2004 | Murphy et al. | |
| 6,739,984 | B1 | 5/2004 | Ciasullo | |
| 6,872,152 | B2 * | 3/2005 | Beach et al. | 473/324 |
| 6,945,876 | B2 | 9/2005 | Nakahara et al. | |
| 7,037,214 | B2 * | 5/2006 | Nakahara et al. | 473/345 |
| 7,128,661 | B2 * | 10/2006 | Soracco et al. | 473/329 |
| 7,128,664 | B2 * | 10/2006 | Onoda et al. | 473/347 |
| 7,258,625 | B2 * | 8/2007 | Kawaguchi et al. | 473/329 |
| 2001/0049310 | A1 | 12/2001 | Cheng et al. | |
| 2002/0160858 | A1 | 10/2002 | Lee | |
| 2003/0083151 | A1 | 5/2003 | Nakahara et al. | |
| 2003/0125127 | A1 | 7/2003 | Nakahara et al. | |
| 2003/0134692 | A1 | 7/2003 | Nakahara et al. | |
| 2003/0134693 | A1 | 7/2003 | Nakahara et al. | |
| 2003/0186760 | A1 * | 10/2003 | Lee | 473/342 |
| 2003/0220155 | A1 * | 11/2003 | Nishitani | 473/335 |
| 2004/0005936 | A1 | 1/2004 | Imamoto et al. | |
| 2004/0033844 | A1 * | 2/2004 | Chen | 473/329 |
| 2004/0116208 | A1 | 6/2004 | DeShiell et al. | |
| 2004/0192463 | A1 * | 9/2004 | Tsurumaki et al. | 473/329 |
| 2004/0254030 | A1 * | 12/2004 | Nishitani et al. | 473/345 |
| 2004/0266551 | A1 | 12/2004 | Noguchi et al. | |
| 2005/0043115 | A1 * | 2/2005 | Lin | 473/345 |
| 2005/0266933 | A1 * | 12/2005 | Galloway | 473/342 |
| 2006/0052177 | A1 * | 3/2006 | Nakahara et al. | 473/329 |
| 2006/0052185 | A1 * | 3/2006 | Kawaguchi et al. | 473/349 |
| 2006/0063608 | A1 * | 3/2006 | Mori et al. | 473/345 |
| 2007/0021234 | A1 * | 1/2007 | Tsurumaki et al. | 473/329 |

FOREIGN PATENT DOCUMENTS

| | | |
|---|---|---|
| JP | 06-039941 | 2/1994 |
| JP | 07-112041 A | 5/1995 |
| JP | 07-112042 A | 5/1995 |
| JP | 07-155410 | 6/1995 |
| JP | 08-024377 | 1/1996 |
| JP | 09-038250 | 2/1997 |
| JP | 09-187534 | 7/1997 |
| JP | 09-215786 | 8/1997 |
| JP | 09-322953 | 12/1997 |
| JP | 10-015119 | 1/1998 |
| JP | 2000-033133 | 2/2000 |
| JP | 2003-320060 | 11/2000 |
| JP | 2001-340499 | 12/2001 |
| JP | 2002-011122 | 1/2002 |
| JP | 2002-224249 | 8/2002 |
| JP | 2003-062130 | 3/2003 |
| JP | 2003-144590 | 5/2003 |
| JP | 2003-205055 A | 7/2003 |
| JP | 2004-016654 | 1/2004 |
| JP | 2004-065810 | 3/2004 |
| JP | 2004-180759 | 7/2004 |
| WO | WO 2004/052472 A1 | 6/2004 |

OTHER PUBLICATIONS

U.S. Appl. No. 10/868,362, filed Jun. 16, 2004, Imamoto et al.*
U.S. Appl. No. 10/868,363, filed Jun. 16, 2004, Yamagishi et al.*
U.S. Appl. No. 10/868,364, filed Jun. 16, 2004, Imamoto et al.*
U.S. Appl. No. 10/981,628, filed Nov. 5, 2005, Imamoto et al.*
U.S. Appl. No. 11/094,355, filed Mar. 31, 2005, Ezaki et al.*
U.S. Appl. No. 11/240,364, filed Oct. 3, 2005, Imamoto et al.*
U.S. Appl. No. 11/252,801, filed Oct. 19, 2005, Imamoto et al.*
U.S. Appl. No. 11/233,143, filed Sep. 23, 2005, Imamoto et al.*

* cited by examiner

GOLF CLUB HEAD

BACKGROUND OF THE INVENTION

1. Field of the Invention

The present invention relates to a hollow golf club head, particularly to a golf club head having a shape of a wood type or a shape approximately the same. More particularly, the invention relates to a golf club head in which at least a central portion of a face portion is made of an amorphous metal.

2. Description of the Related Art

A metal golf club head of a hollow shell structure has come to wide use as a wood-type golf club head, such as a driver or a fairway wood. Generally, a hollow wood-type golf club head has a face portion for hitting a ball; a crown portion forming the upper surface of the golf club head; a sole portion forming the lower surface of the golf club head; a side portion forming side faces on its toe, rear, and heel sides; and a hosel portion. A shaft is inserted into the hosel portion, and fixed thereto by means of an adhesive, or the like. Meanwhile, recently, a number of golf clubs called utility clubs have also been commercially available. A variety of golf clubs having heads analogous to the above-mentioned wood-type golf club head (that is, having a face portion, a sole portion, a side portion, a crown portion, and a hosel portion) are also commercially available as a type of such utility golf clubs.

As a metal for forming the hollow golf club head, an aluminum alloy, stainless steel, or a titanium alloy has been used. Among them, a titanium alloy in particular has been in wide use in recent years.

Generally, when a hollow golf club head is increased in volume, the sweet spot thereof can be expanded. When a volume of a golf club head is increased, accompanying therewith, the weight thereof is likely to be increased. In order to prevent the golf club head from being increased in weight, consideration has been given to employment of a fiber-reinforced plastic whose specific gravity is lower than those of the above-listed metals as the constituent material of the golf club head.

JP-A-2001-340499 discloses a golf club head whose face portion and sole portion are made of a metal, and other portions; that is, a crown portion, and a side portion on the toe and heel sides, are made of a carbon-fiber reinforced thermosetting plastic (CFRP). When the crown portion is made of CFRP, deformation of the crown portion upon hitting a ball is increased, thereby enabling an increase in a launch angle, or a higher coefficient of restitution. However, in the golf club head, a peripheral edge of the face portion is butt-joined to the crown portion and the side portion made of CFRP. When a ball is hit, extreme stress is applied to a joint portion between the crown portion and the face, and that between the side portion and the face. Accordingly, after repeated use, the joints may be separated.

JP-A-2003-62130 discloses a golf club head, wherein a front edge portion of a crown portion, a front edge portion of a sole portion, and front edge portions of two side portions are integrally forged with the face portion, from titanium; a body made of a resin material is affixed to the titanium face element so as to continue therefrom; and an aluminum plate is disposed on the sole portion. The face element includes the front edge portion of the crown portion, the front edge portion of the sole portion, and the front edge portions of the two side portions. Accordingly, a bonding strength between the face element and the resin body can be rendered greater than that of the joint between the crown portion made of a CFRP and the metal face disclosed in JP-A-2001-340499. Meanwhile, in the golf club head disclosed in JP-A-2003-62130, the aluminum plate of the sole portion overlaps the titanium face element from below.

SUMMARY OF THE INVENTION

Since the golf club head disclosed in JP-A-2003-62130 is configured such that the aluminum plate of the sole portion is continues from the face element so as to increase rigidity, deformation on the sole side upon hitting of a ball is small. The present invention aims at providing a golf club head in which deformation on the sole side upon hitting of a ball is large, and having a great coefficient of restitution. The present invention also aims at increasing coefficient of restitution of the metal face, thereby providing a golf club head which can increase a carry distance of a golf ball.

According to an embodiment of the present invention, there is provided a golf club head of a hollow shell structure, the golf club head including: a first member made of a metal, including a face portion and a peripheral portion continuous with the face portion; a metal sole plate extending in a front-rear direction of the golf club head on a sole portion and independent from the first member; and a second member made of a fiber reinforced plastic, wherein at least a central portion of the face portion is made of an amorphous metal, other portions of the first member is made of a crystalline metal, and the first member and the metal sole plate have a gap therebetween, and are affixed together by the second member.

Further, the first member can include a main body made of a crystalline metal and a face plate made of an amorphous metal, the main body can be provided with an opening on the central portion of the face portion, and the face plate can be mounted in the opening.

The face plate can be fixedly attached to the main body by a caulked portion on a peripheral edge portion of the opening.

The main body can be made by forging, and a hosel portion can be provided by machine work.

The sole plate can be made of a metal material whose specific gravity is higher than that of a crystalline metal.

The metal material having a high specific gravity can be stainless steel.

A weight member made of a material whose specific gravity is higher than that of the sole plate can be fixedly attached on a rear portion of the sole plate.

The weight member can be attached to a cylindrical portion provided on the sole plate in a penetrating manner.

A volume of the golf club head can fall within a range of 300 to 500 cc, and a weight of the golf club head can fall within a range of 180 to 210 g.

The second member between the first member and the sole plate can be recessed inward of the golf club head more than bottom faces of the first member and the sole plate.

A crown portion and the sole portion of the firs member can have greater widths in the front-rear direction of the golf club head on a heel side and toe side of the golf club head than at a center portion between the heel side and the toe side.

The golf club head according to the embodiment of the present invention, the second member between the first member and the sole plate is deformed when a ball is hit thereon. Accordingly, coefficient of restitution of the golf club head is increased, whereby a carry distance of a golf ball is increased.

In the configuration of the invention, at least the central portion of the face portion is made of an amorphous metal. Since the amorphous metal is higher in strength and lower in elasticity than a crystalline metal, when the face portion is reduced in thickness so as to increase the degree of deformation thereof upon hitting of a ball, restitution is increased, whereby a carry distance of a golf ball can be increased.

Meanwhile, unlike a crystalline metal, it is difficult to apply forging, presswork, or welding to an amorphous metal. Consequently, the first member may be formed of a main body in which at least the central portion of the face portion is provided with an opening and which is made of a crystalline metal; and a face plate which is made of an amorphous metal attached to the opening. In this case, the face plate may be fixed onto the main body by means of caulking the peripheral edge portion of the opening of the main body.

The second member between the metal first member and the sole plate is preferably recessed a greater extent upward than the sole plate and the bottom face of the first member. By virtue of the above configuration, even when the sole face of the golf club head strikes the ground strongly, the second member is highly resistant to damage.

In the crown portion and the sole portion of the first member of the invention, the widths of the golf club head in the front-rear direction at the heel side and the toe side are preferably larger than those at the center portion between the heel side and the toe side. By virtue of the above configuration, the moment of inertia of the golf club head can be increased.

The present invention is suitable for applying to a large driver head whose weight is necessarily suppressed to about 180 to 210 g, while having a large volume of about 300 to 500 cc.

As an amorphous metal composition forming at least the central portion of the face portion, a zirconium amorphous alloy is preferable, and a zirconium amorphous alloy represented by a general formula ZrMX is particularly preferable, where M is one or more metal elements selected from V, Cr, Mn, Fe, Co, Ni, Cu, Ti, Mo, W, Ca, Li, Mg, Si, Al, Pd, and Be; and X is one or more metal elements selected from Y, La, Ce, Sm, Md, Hf, Nb, and Ta. Meanwhile, the amorphous metal may be a completely amorphous metal, or a semi-amorphous metal which partially includes crystalline metal.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Figure 1:
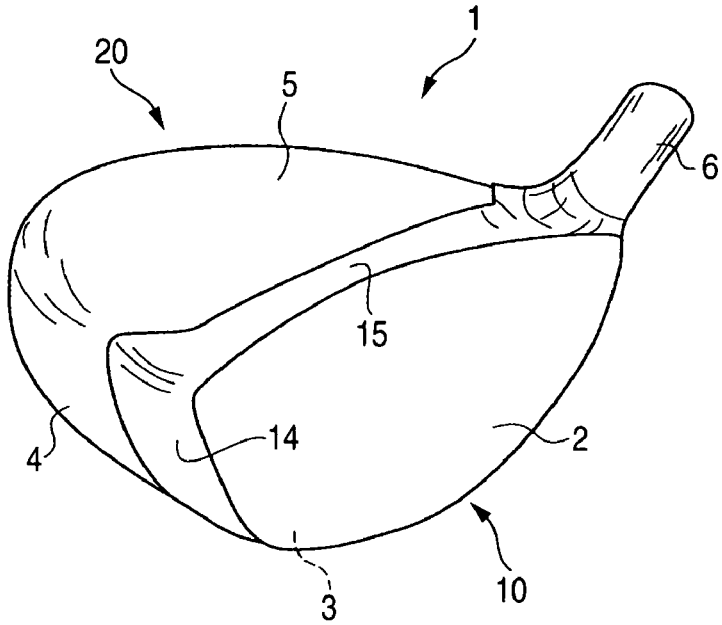
FIG. 1 is a perspective view of a golf club head according to an embodiment of the invention.
Figure 2:
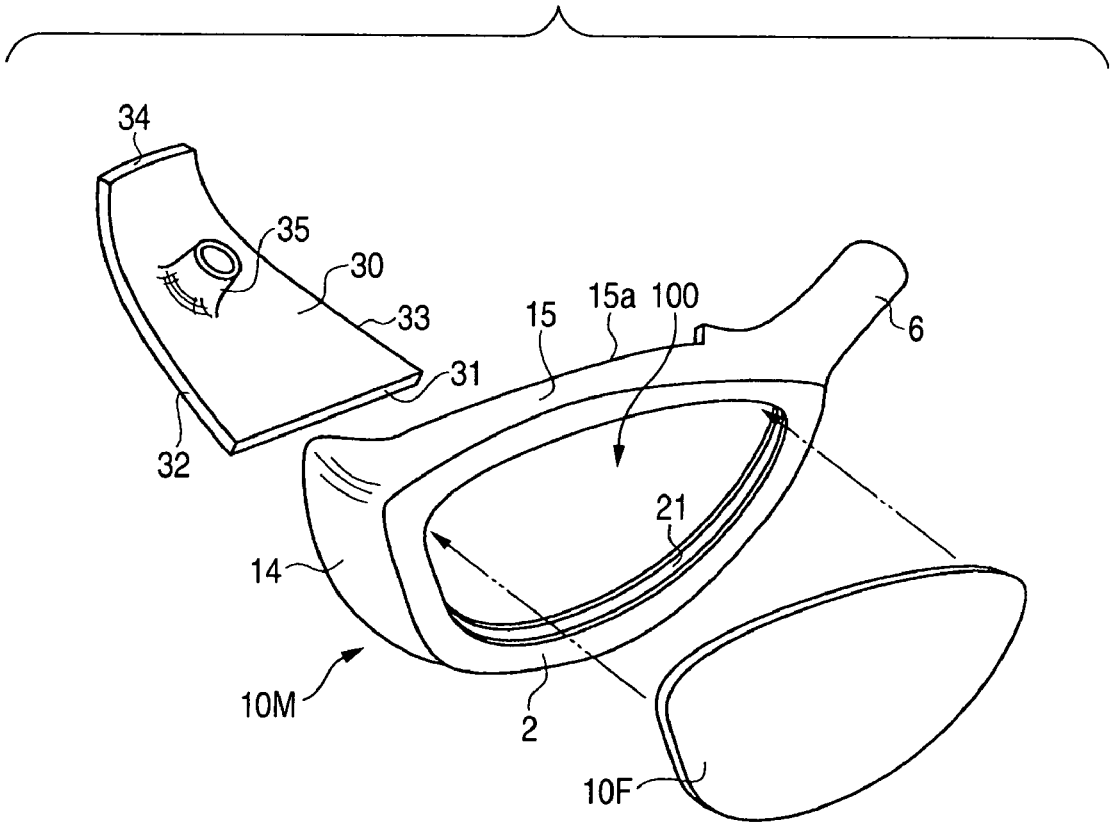
FIG. 2 is an exploded perspective view and a sole plate of a front-face body of the golf club head of FIG. 1, as viewed from the front.
Figure 3A:
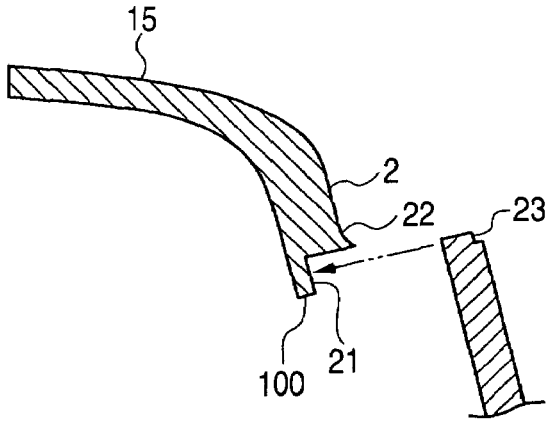
FIGS. 3*a* and 3*b* are enlarged cross-sectional views showing an engagement structure between a front-face main body and a face plate.
Figure 3B:
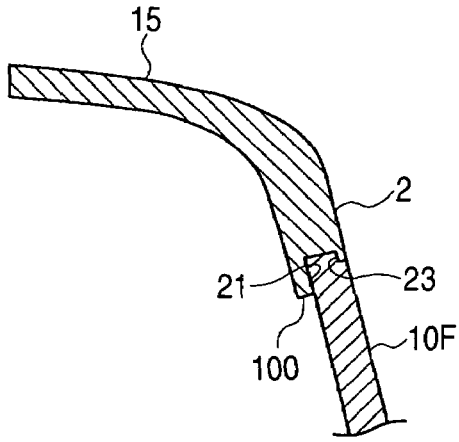
Figure 4:
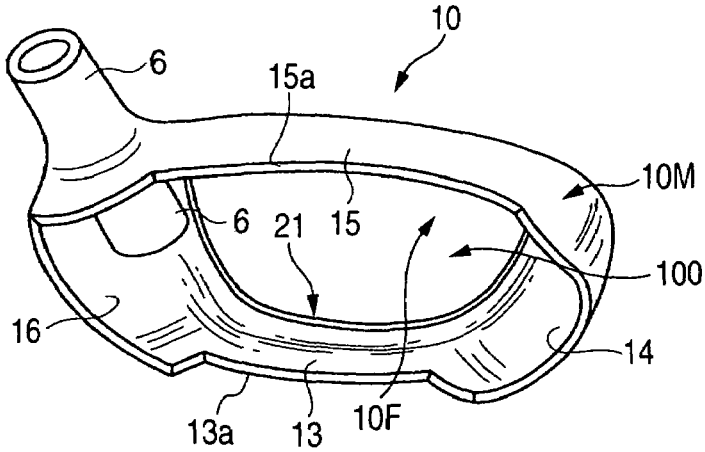
FIG. 4 is a perspective view of the front-face body of the golf club head of FIG. 1, as viewed from the rear.
Figure 5:
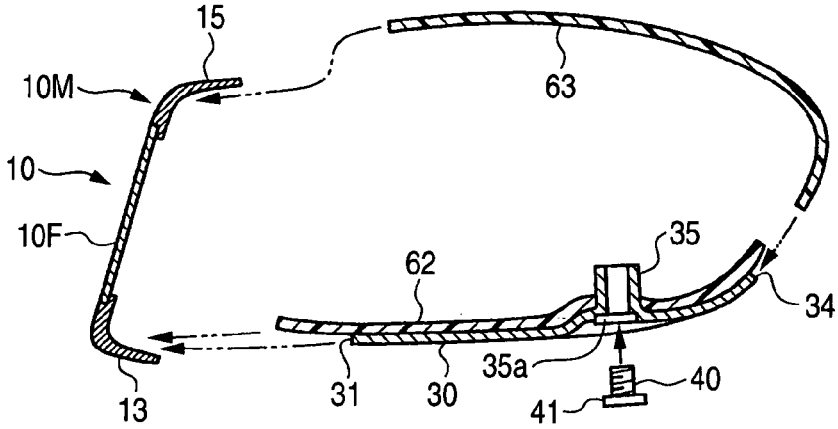
FIG. 5 is a cross-sectional view showing a method for manufacturing the golf club head of the invention.
Figure 6A:
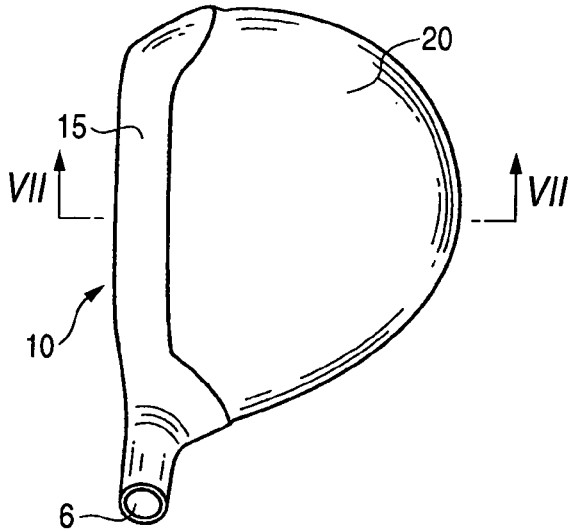
FIG. 6A is a plan view of the golf club head.
Figure 6B:
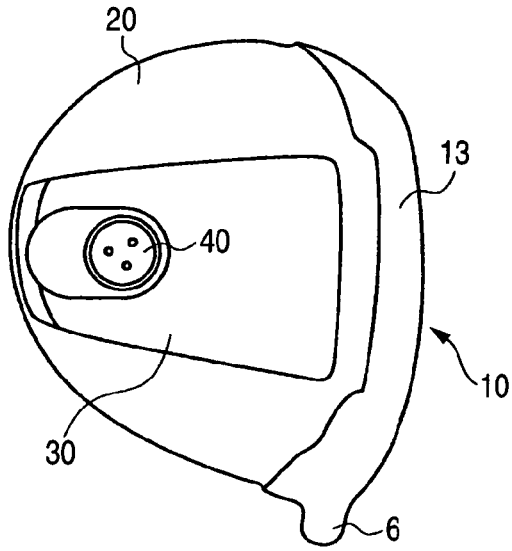
FIG. 6B is a bottom view of the golf club head.
Figure 7A:
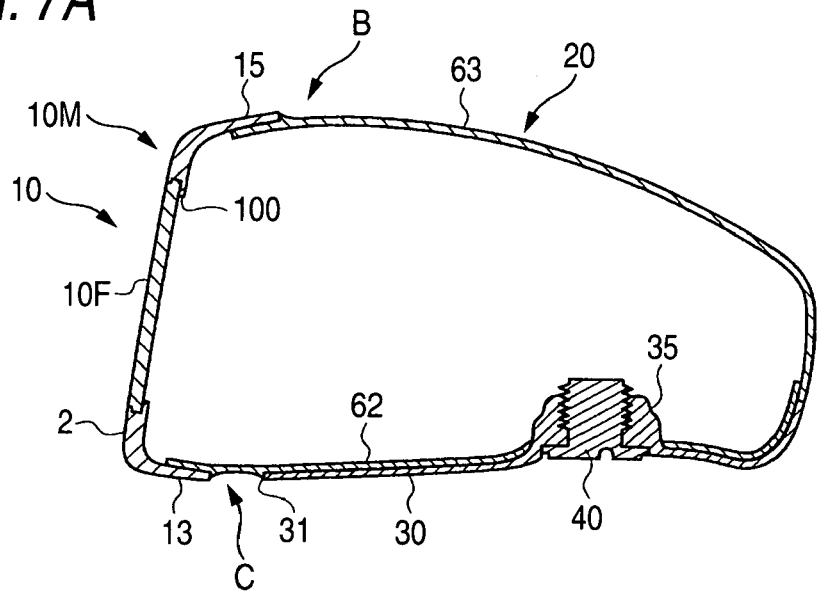
FIG. 7A is a cross-sectional view taken along line VII-VII of FIG. 6A.
Figure 7B:
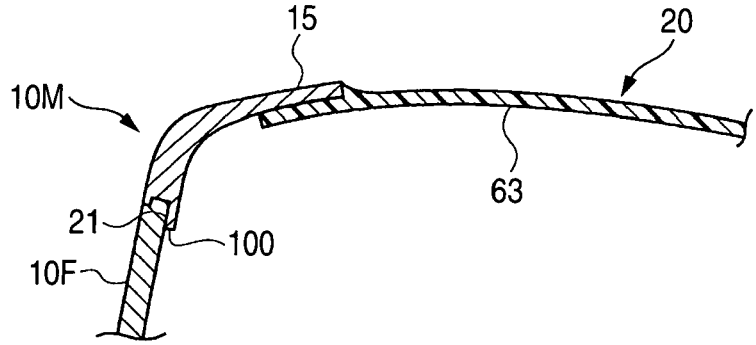
FIG. 7B is an enlarged view of a B portion of FIG. 7A.
Figure 7C:
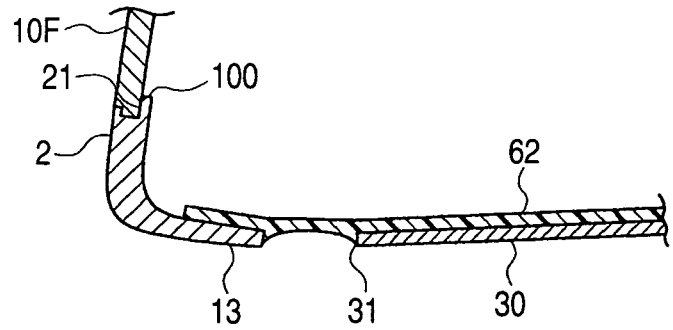
FIG. 7C is an enlarged view of a C portion of FIG. 7A.

Hereinafter, an embodiment of the invention will be described by reference to the drawings. FIG. 1 is a perspective view of a golf club head according to an embodiment of the invention. FIG. 2 is a perspective view of a front-face body and a sole plate of the golf club head, as viewed from the front. FIG. 3 is an enlarged cross-sectional view showing an engagement structure between a front-face body main body and a face plate. FIG. 4 is a perspective view of the front-face body as viewed from the rear. FIG. 5 is a cross-sectional view showing a method for manufacturing the golf club head. FIG. 6A is a plan view of the golf club head. FIG. 6B is a bottom view of the golf club head. FIG. 7A is a cross-sectional view taken along line V-V of FIG. 6A. FIG. 7B is an enlarged view of a portion B of FIG. 7A, and FIG. 7C is an enlarged view of a portion C of FIG. 7A. FIGS. 8A to 8E are explanatory views of prepreg sheets used for manufacturing an FRP body of the golf club head.

Reference numeral 1 denotes the golf club head 1, which is a wood-type hollow golf club head of a shell structure having a face portion 2, a sole portion 3, a side portion 4, a crown portion 5, and a hosel portion 6.

The face portion 2 is a face for hitting a ball, and unillustrated grooves (score lines) are disposed thereon. The sole portion 3 forms the lower surface of the golf club head. The side portion 4 forms the side faces on the toe, heel, and rear-face sides. The crown portion 5 forms the upper surface of the golf club head. A shaft is inserted into the hosel portion 6 and fixedly attached thereto by means of an adhesive.

The golf club head 1 is formed with a metal front-face body 10, a fiber-reinforced plastic body (hereinafter referred to as an "FRP body") 20, a metal sole plate 30 and a weight member 40. The weight of the front-face body is preferably 20 to 70% of the weight of the golf club head, and particularly preferably 30 to 60% of the same.

As shown in FIGS. 2 and 3, the front-face body 10 is integrally formed from a front-face body main body 10M made of. a crystalline metal, and a face plate 10F made of an amorphous metal. Here, the front-face main body 10M is configured with a peripheral edge portion of the face portion 2, a metal sole portion 13, a metal side portion (toe) 14, a metal crown portion 15, a metal side portion (heel) 16, and the hosel portion 6.

Examples of the crystalline metal forming the front-face bodymain body 10M include lightweight titanium, titanium alloy, and aluminum alloy.

In the front-face body main body 10M, an opening 100 is provided so as to leave the peripheral edge portion of the face portion 2. The face plate 10F made of an amorphous metal is fitted in the opening 100, and fixedly attached thereto. In the embodiment, a stepped portion 21 is provided on the inner peripheral edge portion of the opening 100, and on the front face of an element assembly of the front-face body main body 10M before attachment of the face plate 10F, a flange 22 is provided circumferentially along an edge portion of the opening 100. A recessed step portion 23 is provided circumferentially along the peripheral edge portion on the front-face side of the face plate 10F. The face plate 10F is fitted to the opening 100 so as to contact the stepped portion 21. Thereafter, the flange 22 is caulked to thus crimp the recessed step portion 23. Consequently, the face plate 10F is fixedly attached to the peripheral edge portion of the face portion 2.

By an effect of being substantially tabular, the faceplate 10F can be manufactured easily even when made of an amorphous metal. By an effect of being made of a crystalline metal, the front-face body main body 10M can be manufactured easily by means of any of a variety of methods, such as casing, forging, press, cutting and welding.

The metal sole portion 13 of the front-face body main body 10M forms a front edge portion of the sole portion 3. The metal side portions 14, 16 form a front edge portion of the side portion 4. The metal crown portion 15 forms a front edge portion of the crown portion 5. The metal crown portion 15 is continuous with the metal side portion (toe) 14 and the metal side portion (heel) 16. The metal side portion (toe) 14 and the metal side portion (heel) 16 are respectively continuous with the metal sole portion 13. The metal side portions 14, 16 and the metal sole portion 13 are continuous with the face portion 2.

Widths of the metal sole portion 13 and the metal crown portion 15 in the front-rear direction (i.e., the widths perpendicular to the face portion 2) are large on the toe side and the heel side thereof; and are small at remaining center portions 13*a*, 15*a*. By virtue of the above configuration, the moment of inertia of the golf club head increases. Meanwhile, the widths in the front-rear direction are gradually reduced respectively from the toe side and heel side to the center portions 13*a*, 15*a*.

In relation to the lengths of the center portions 13*a*, 15*a* having small widths in the front-rear direction, the length of the center portion 13*a* in the sole portion is preferably about 55 to 80% of the maximum width of the front-face body 10 with respect to the toe-heel direction; and the center portion 15*a* in the crown portion is preferably about 50 to 85% of the maximum width of the front-face body 10 with respect to the toe-heel direction.

The width of the center portion 15*a* of the metal crown portion 15 is preferably about 50 to 95% of the maximum width of the front-face body 10, particularly preferably about 55 to 70%; and that of the metal sole portion 13 is preferably about 50 to 95% of the maximum width of the front-face body 10, particularly preferably about 55 to 65%.

The front-face body main body 10M is particularly preferably formed integrally by means of casting or forging. Meanwhile, in the case of forging, the hosel portion is formed through machine work. Preferably, the hole diameter of the hosel portion is approximately 0.1 to 0.3 mm larger than the diameter of the tip of the shaft, which is to be attached therein. The entrance side of the hosel portion is preferably chamfered in a taper so as to ease shearing stress applied to the shaft.

The front-face body main body can also be formed by means of bonding a plurality of sections, which have been formed separately, by welding or the like.

As shown in FIGS. 7A and 7C, an average gap of 4 to 12 mm, particularly a gap of 7 to 9 mm, exists between a front edge 31 of the sole plate 30 and the metal sole portion 13. A sole 62 of the FRP body 20 is present therebetween. The sole 62 of the FRP body 20 between the metal sole portion 13 and the front edge 31 of the sole plate 30 is recessed to a greater extent upward than the bottom faces of the metal sole portion 13 and the sole plate 30. The average depth of the recess is preferably about 0.7 to 1.5 mm. Since the sole 62 of the FRP body 20 is recessed, the sole 62 of the FRP body 20 in the recess is prevented from being damaged by strongly striking the ground at the time of sclaffing. Meanwhile, the bottom face of the sole 62 of the FRP body 20 in the recess is, as shown in FIG. 7C, curved in an arch in the front-rear direction of the golf club head.

A rear edge 34 of the sole plate 30 is located in the vicinity of the rearmost portion of the golf club head 1; however, it is located slightly frontward of the rearmost end of the golf club head 1.

The sole plate 30 is disposed in the vicinity of the center of the sole portion 13 in the toe-heel direction. As shown in FIG. 2, the sole plate 30 is a substantially quadrangular plate having the front edge 31 facing the metal sole portion 13, side edges 32, 33 extending rearward from the respective ends of the front edge 31, and the rear edge 34. The front edge 31 is longer than the rear edge 34, and the side edges 32, 33 come closer together towards the rear of the sole plate. Accordingly, the sole plate 30 is substantially trapezoidal in plan view. The sole plate 30 is curved in conformance with the sole face of the golf club head 1.

A length of the front edge 31 of the sole plate 30 is preferably about 50 to 75%, particularly preferably about 60 to 75%, the length of the center portion 13*a* of the metal sole portion 13 in the toe-heel direction; and a length of the rear edge 34 is preferably about 50 to 80%, particularly preferably about 55 to 75% of the length of the front edge 31.

The length of the sole plate 30 in the front-rear direction is preferably about 65 to 90%, particularly preferably about 75 to 85% of the length of the golf club head 1 in the front-rear direction.

The sole plate 30 is preferably made of a metal material, such as stainless steel, an aluminum alloy, a copper alloy, or a titanium alloy. Among them, stainless steel, which has a high specific gravity, is preferable, in view of appearance, resistance to corrosion, hardness, and the like.

At the rear of the sole plate 30, a cylindrical portion 35 stands toward the inside the golf club head 1. The weight member 40 is fixedly attached in an inner hole of the cylindrical portion 35 by means of screw engagement.

A flange 41 (FIG. 5) is disposed at the lower end of the weight member 40. A stepped portion 35*a* for receiving the flange 41 is disposed at the lower edge of the inner hole of the cylindrical portion 35.

The sole plate 30 is recessed to a certain extent on the periphery of the cylindrical portion 35.

The weight member 40 is made of a metal whose specific gravity is higher than that of the sole plate 30; for instance, tungsten or a tungsten alloy (e.g., a W—Ni alloy, a W—Cu alloy). A W—Ni alloy and a W—Cu alloy have superior machinability and are easily screw-threaded. The specific gravity of the weight member 40 is preferably higher than or equal to 10, particularly preferably about 10 to 15. The center position of the weight member 40 is located toward the rear side from the center of the golf club head 1 in the front-rear direction.

Next, a method for manufacturing the golf club head will be described.

The golf club head 1 is manufactured from the front-face body 10, which is formed by means of integrating the front-face body main body 10M and the face plate 10F; the sole plate 30; and a plurality of prepreg sheets.

Figure 8A:
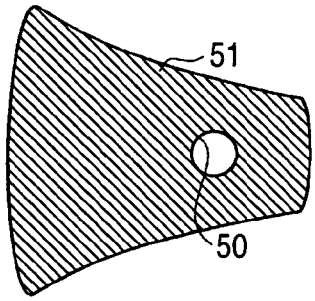
FIGS. 8A to 8E are explanatory views of prepreg sheets used for manufacturing the FRP body of the golf club head.
Figure 8B:
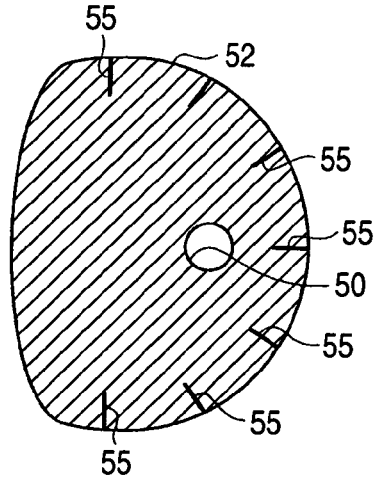
Figure 8C:
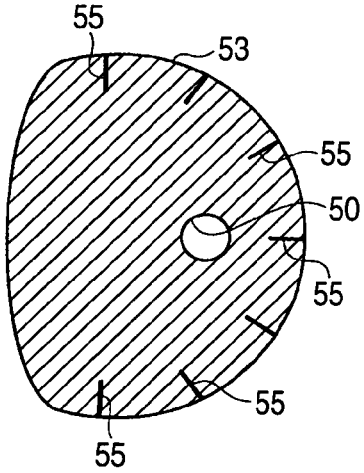
Figure 8D:
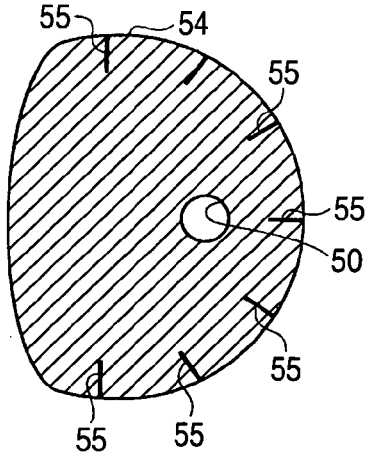
Figure 8E:
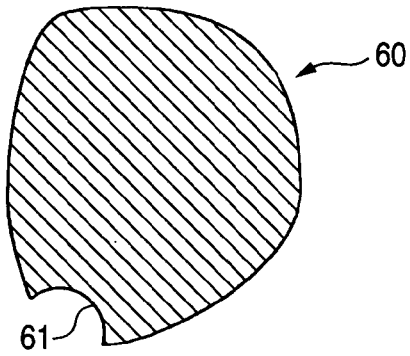

FIGS. 8A to 8E are plan views showing prepreg sheets employed in the embodiment. FIG. 8A shows a prepreg sheet 51 of a carbon fiber cloth, which is impregnated with a thermosetting synthetic resin. FIGS. 8B, 8C, 8D and 8E show prepreg sheets 52, 53, 54 and 60, in which carbon fibers are aligned in one direction and which is impregnated with a thermosetting synthetic resin. The prepreg sheets 51 to 54 form the sole 62 which is the lower half side of the FRP body 20. Circular openings 50 for allowing the cylindrical portion 35 of the sole plate 30 therethrough are respectively disposed in the prepreg sheets 51 to 54.

The prepreg sheet 51 is directly superimposed on the sole plate 30, and is of a substantially trapezoidal shape whose size is larger than the sole plate 30.

The prepreg sheets 52, 53 and 54 are superimposed on the prepreg sheet 51 in this order. These prepreg sheets 52 to 54, which form the sole 62 of the FRP body 20, are equal in size to the developed sole 62 of the FRP body 20. On two sides and the rear edge of the prepreg sheets 52 to 54, a plurality of cut 55 are provided with a predetermined interval therebetween so that the two sides and the rear edge of the prepreg sheets 52 to 54 are curved in conformance with the inner surface of a forming die.

In the prepreg sheet 52, carbon fibers are aligned in the toe-heel direction. In the prepreg sheet 53, carbon fibers are aligned so as to obliquely intersect the toe-heel direction at an angle of 60° in a clockwise direction. In the prepreg sheet 54, carbon fibers are aligned so as to obliquely cross the toe-heel direction at an angle of 60° counterclockwise therefrom.

The prepreg sheet 60 is a sheet for forming a crown 63 which forms the crown portion 5 and is the upper surface side of the FRP body 20, and a substantially semicircular notch 61, in which the hosel 6 is to be engaged, is provided thereon.

For manufacturing the golf club head 1, first, the sole plate 30 is placed in a die having a cavity face having a shape of the sole and side of the golf club head 1. The prepreg sheets 51 to 54 are stacked thereon in the this order. Then, the prepreg sheets 51 to 54 are heated for a short period of time to cause semi-hardening, to thus assume the shape of the sole 62 of the FRP body 20 as shown in FIG. 5, and integrated with the sole plate 30.

The prepreg sheet 60 is also placed in a die having a cavity face having a shape of the crown portion, and heated for a short period. of time to cause semi-hardening, to thereby be formed into the shape of the crown 63 of the FRP body 20 as shown in FIG. 5.

Thereafter, the prepreg sheet 60, the prepreg sheets 51 to 54 provided with the sole plate, and the metal front-face body 10 are placed in a forming die (not shown) of the golf club head 1.

At this time, the front edge of the crown 63 formed with the prepreg sheet 60 overlaps the lower surface (the inner side face of the head) of the metal crown portion 15. In addition, the front edge of the sole 62 formed with the prepreg sheets 51 to 54 overlaps the upper surface (the inner side face of the head) of the metal sole portion 13. As shown in FIG. 5, the front edge of the sole 62 protrudes forward of the front edge 31 of the sole plate 30; and the rear edge of the sole 62 protrudes rearward of the rear edge 34 of the sole plate 30. The rear edge of the crown 63 overlaps the outer face of the rear edge of the sole 62.

Next, while heating the forming die, gas pressure of air or the like is introduced into the forming die by way of the cylindrical portion 35. The crown 63 and the sole 62, which are formed from the semi-hardened prepreg sheets, are pressed against the inner face of the forming die, whereby the prepreg sheets are sufficiently hardened, the crown 63 and the sole 62 are fixedly attached to the front-face body 10, and the crown 63 and the sole 62 are caused to bond.

During the course of formation, a portion of the synthetic resin in the prepreg sheets intrudes between the metal sole 13 and the sole plate 30, whereby the recessed portion in which the sope 62 of the FRP body 20 is curved in an arch shape, is formed as shown in FIG. 7C.

Thereafter, the product is released out of the die, the weight member 40 is screwed into the cylindrical portion 35, and finishing treatment, such as trimming and coating, is applied, whereby the product of the golf club head 1 is obtained.

Of the golf club head configured as above, the face plate 10F is made of an amorphous metal. Accordingly, when the face plate 10F is reduced in thickness so as to increase the degree of deformation of the face portion 2 upon hitting of a ball, restitution property is increased, whereby a carry distance of a golf ball can be increased. In addition, of the golf club head, portions continuous from the front-face body 10, including the portion between the front-face body 10 and the sole plate 30, are all made of FRP. Accordingly, the head is easily deformed upon hitting of a ball, thereby achieving high restitution as well as bringing the center of the gravity to a deeper position. In particular, in the embodiment, since the crown portion 5 of the FRP body 20 is easily deformed, a launch angle can be increased so as to increase a carry distance of a golf ball.

In the embodiment, the FRP body 20 is affixed also to the inner surface of front-face body 10 in close contact and in an overlapping manner. Accordingly, bonding between the front-face body 10 and the FRP body 20 is firm, and exhibits excellent durability. Meanwhile, the average value of the width of the metal crown portion 15 and those of the metal side portions 14, 16 in the front-rear direction (i.e., the face-back direction) are preferably about 2 to 20 mm, particularly preferably about 5 to 18 mm.

In the golf club head according to the embodiment, the metal sole portion 13, the metal side portion 14, and the metal crown portion 15 are disposed all around the circumference of the face portion 2. Accordingly, the peripheral edge portion of the face portion 2 has high rigidity. Therefore, even when the face portion 2 is reduced in thickness, the front-face body 10 as a whole is provided with a required strength.

Of the golf club head, the front edge portion of the sole portion 3 is formed with the metal sole 13. Accordingly, even when the front edge portion of the sole portion 3 hits the ground (in a so-called "sclaffing") at the time of a swing, the front edge portion of the sole 13 is not impaired.

In the golf club head, the metal sole plate 30 extends in the front-rear direction at the center of the sole portion 3. Accordingly, the center of gravity of the golf club head can be lowered, whereby a ball can be hit high. In addition, since the sole plate 30 extends rearward, the center of gravity of the golf club head is brought to a deeper position, thereby expanding the sweet spot. In addition, since the weight main body 40 is fixedly attached to the rear of the sole plate 30, the center of gravity is brought to a further deeper position.

In the embodiment, a portion of the hosel portion 6 is disposed inside the golf club head as shown in FIG. 4. Accordingly, the center of gravity can be lowered.

In addition, when a part of the hosel portion 6 is disposed inside the golf club head as described above, torsional moment applied to the shaft at the time of hitting a ball is reduced, whereby side-to-side runout of the thus-hit ball is suppressed. Meanwhile, by means of reducing the protrusion length of the hosel portion 6 out of the external surface of the golf club head, the external appearance of the golf club head also becomes favorable.

The length of the portion of the hosel portion 6 protruding into the golf club head is preferably 10 to 50 mm, particularly preferably 20 to 50 mm, and further preferably 35 to 45 mm.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A golf club head of a hollow shell structure, the golf club head comprising:

a first member made of a metal, including a face portion and a peripheral portion continuous with the face portion;

a metal sole plate extending in a front-rear direction of the golf club head on a sole portion and independent from the first member; and a second member made of a fiber reinforced plastic, wherein at least a central portion of the face portion is made of an amorphous metal, other portions of the first member are made of a crystalline metal, and the first member and the metal sole plate have a gap therebetween, and are affixed together by the second member, wherein the gap between the first member and the metal sole plate is formed to be in a range from 4 mm to 12 mm, and the second member is exposed outward at the gap and formed with a recess that is concaved upward from a bottom face of the metal sole plate at the gap.

2. A golf club head of a hollow shell structure, the golf club head comprising:

a first member made of a metal, including a face portion and a peripheral portion continuous with the face portion;

a metal sole plate extending in a front-rear direction of the golf club head on a sole portion and independent from the first member; and a second member made of a fiber reinforced plastic, wherein at least a central portion of the face portion is made of an amorphous metal, other portions of the first member are made of a crystalline metal, and the first member and the metal sole plate have a gap therebetween, and are affixed together by the second member, wherein the second member is exposed outward at the gap and formed with a recess that is concaved upward from a bottom face of the metal sole plate at the gap, and the recess has an average depth in a range from 0.7 mm to 1.5 mm.

* * * * *